United States Patent [19]

Prestegaard

[11] 3,981,494

[45] Sept. 21, 1976

[54] BLANK FEEDER APPARATUS

[76] Inventor: Paul G. Prestegaard, 201 Westwood Drive, Minneapolis, Minn. 55416

[22] Filed: May 8, 1975

[21] Appl. No.: 575,713

[52] U.S. Cl. ..... 271/10; 214/8.5 G; 271/35; 271/99; 271/112; 271/119; 271/165; 271/171

[51] Int. Cl.[2] ..... B65H 3/04; B65H 3/06; B65H 1/06

[58] Field of Search ..... 271/35, 10–13, 271/1, 99, 112, 119, 131, 132, 139, 133, 140, 144, 165, 171, 271, 126, 166, 134, 135; 214/8.5 G

[56] References Cited

UNITED STATES PATENTS

| | | | |
|---|---|---|---|
| 1,647,819 | 11/1927 | Swift | 271/35 |
| 2,379,361 | 6/1945 | La Bombard | 271/119 X |
| 2,573,944 | 11/1951 | Anderson | 271/35 |
| 3,262,697 | 7/1966 | Krinke | 271/35 X |

*Primary Examiner*—Evon C. Blunk
*Assistant Examiner*—Bruce H. Stoner, Jr.
*Attorney, Agent, or Firm*—Dugger, Johnson & Westman

[57] ABSTRACT

For feeding blanks into, for example, a carton folding machine, blank feeder apparatus that includes a frame, blank support members having rear and intermediate portions that are forwardly and upwardly inclined and front portions that extend generally horizontally; a magazine for retaining the blanks in generally vertical stacked relationship on the support members, including hold down assemblies for resiliently urging the blank rear edge portions downwardly, and front escape bars; kicker assemblies for feeding the lowermost blank in the magazine forwardly, including endless chains having wedges thereon for lifting the adjacent part of the blank and a ledge adjacent the wedge to engage the blank rear edge to positively move the blank; feed rolls adjacent the front of the magazine to aid in moving the lowermost blank forwardly; and solenoid operated clutch mechanism for starting and stopping the drive to the feed rolls and the kicker assemblies. The support members have vacuum ports to pull the front end portion of the lowermost blank down beneath the escape bars. The kicker assemblies are longitudinally adjustable while the magazine is adjustable for holding various length and width blanks.

39 Claims, 12 Drawing Figures

200
226a
226
230
228
227a
231
227b
225
227
227c
226a
200
90
91
89
42
41
84
118
50
113
42
85
38
32
B
68
59
58
33
35
194
198
192
193
197
70
60
67
10
105
146
31
155
110
106
107
104
24
167
27
157
13
14
20
21
24
12
11
15

FIG. 3
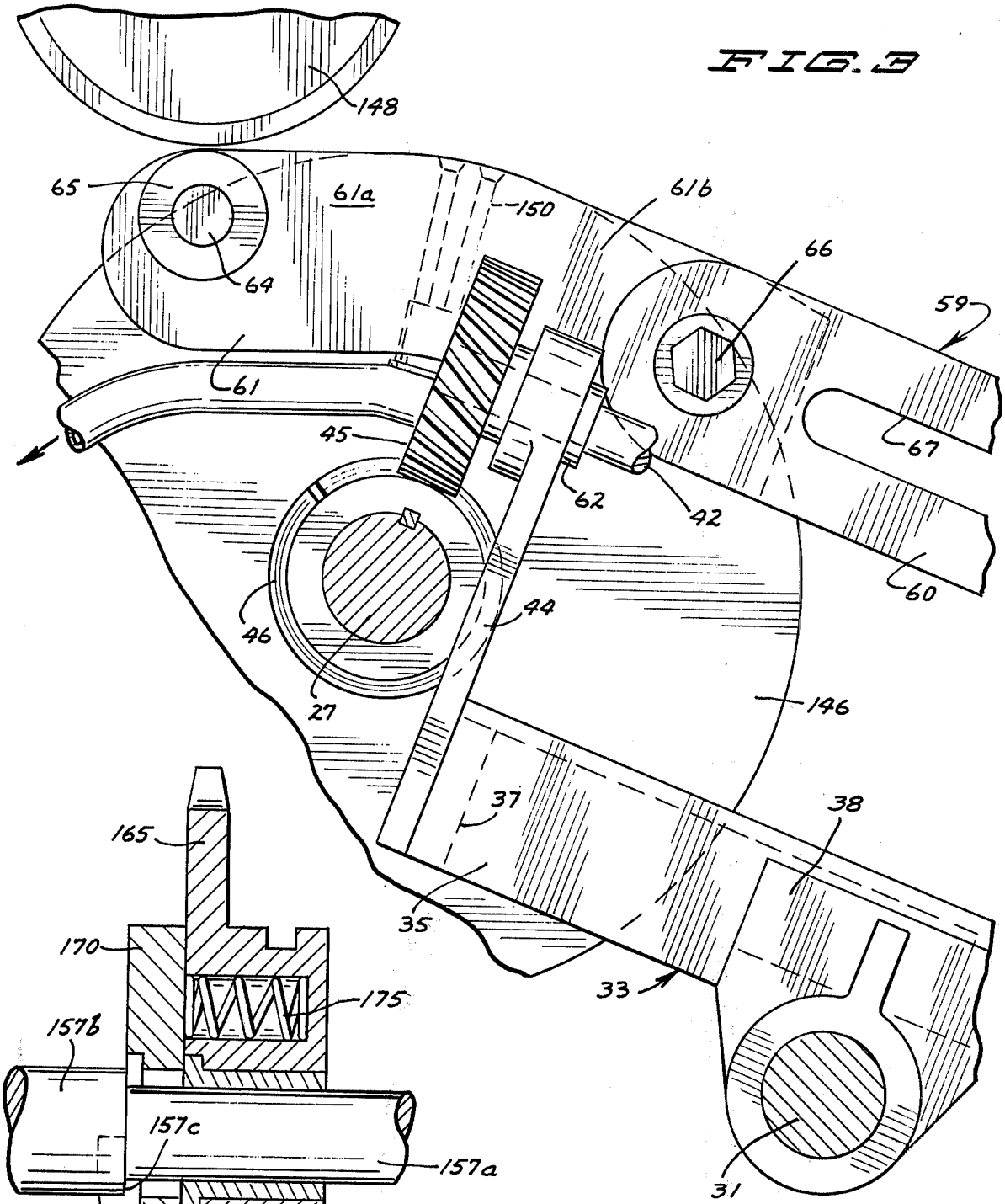
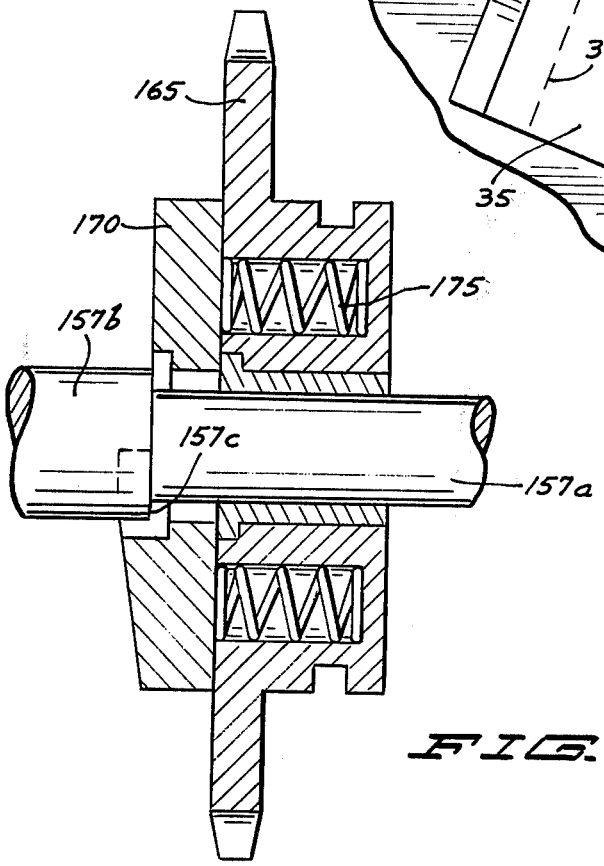
FIG. 8

200
225
226
232
226
228
227c
231
230
227b 161
162
27
168
160
167
200
159
158
165
166
170
186a
201
179a
177
180
182
157
157b
157a
178
181
179
173
171
154
172
183
156
185a
155
186
240
BLANK SENSING CONTROL
185

BLANK FEEDER APPARATUS

BACKGROUND OF THE INVENTION

Blank magazine and feeder apparatus for feeding the lowermost blank of a stack of flat, folded blanks forwardly into, for example, a carton folding machine.

In the prior art there is a problem of relatively high speed feeding of flat folded blanks into processing machines, for example, carton folding machines in proper registry, particularly if the feeder is adapted to be used for feeding different size blanks. This invention is directed toward solving problems such as the above, as well as others.

SUMMARY OF THE INVENTION

For feeding blanks into a processing machine, for example, a carton folding machine, feed apparatus that has slide support bars, a magazine for retaining a stack of flat folded blanks in alignment with the lowermost blank on the support bars and wedge members having kicker ledges on endless chains for initially slightly elevating the adjacent rear part of the lowermost blank and positively engaging the rear edge of the lowermost blank to feed it forwardly. Advantageously, picker rolls are mounted adjacent the front of the magazine to aid in moving the lowermost blank forwardly.

One of the objects of this invention is to provide new and novel feeder apparatus for successively feeding the lowermost blank in a magazine into a processing machine, for example, a carton folding machine. In furtherance of the above object, it is another object of this invention to provide the magazine with new and novel hold down mechanism for resiliently urging the rear edge portions of a stack of blanks in the magazine downwardly. In still furtherance of either or both of the above objects, it is another object of this invention to provide new and novel kicker mechanism for slightly elevating the rear edge portions of the stack of blanks and thence engage the rear edge of the lowermost blank to move said lowermost blank forwardly. Another object of this invention is to, in conjunction with the last mentioned object, provide new and novel means for intermittently exerting a forward pulling force on the portion of the lowermost blank adjacent the front of the magazine.

An additional object of this invention is to provide new and novel mechanism for controlling the maximum acceleration of mechanism for positively engaging the rear edge of the lowermost blank and moving said blank forwardly. Another object of this invention is to provide new and novel mechanism in a blank feeder to retain the rotating elements thereof in register with the machine served even though the magazine of the feeder is adjusted for different size blanks.

A further object of this invention is to provide new and novel clutch apparatus for starting and stopping the drive to the feeder for feeding a blank without interrupting the drive to the machine served, and still provide for coupling the feeder drive to the machine drive. A still further object of this invention is to provide a new and novel mounting of various magazine elements to facilitate the adjustment of the blank feeder for feeding different size blanks.

BRIEF DESCRIPTION OF THE DRAWINGS

FIG. 1 is a side elevational view of the blank feeder apparatus of this invention with parts thereof broken away, and a rear portion of a conventional carton folding machine, said view being generally taken along the line and in the direction of the arrows 1—1 of FIG. 2;

FIG. 3 is an enlarged, fragmentary, longitudinally sectional view of the mechanism of the feeder apparatus of this invention that is adjacent the carton folding machine, said view being generally taken along the line and in the direction of the arrows 3—3 of FIG. 2;

FIG. 8 is a fragmentary cross-sectional view of a portion of the clutch mechanism of FIG. 7 to more clearly show the structural features thereof;

FIG. 11 is a fragmentary side view of a modified embodiment of a blank bottom support mechanism.

Figures 2, 22:
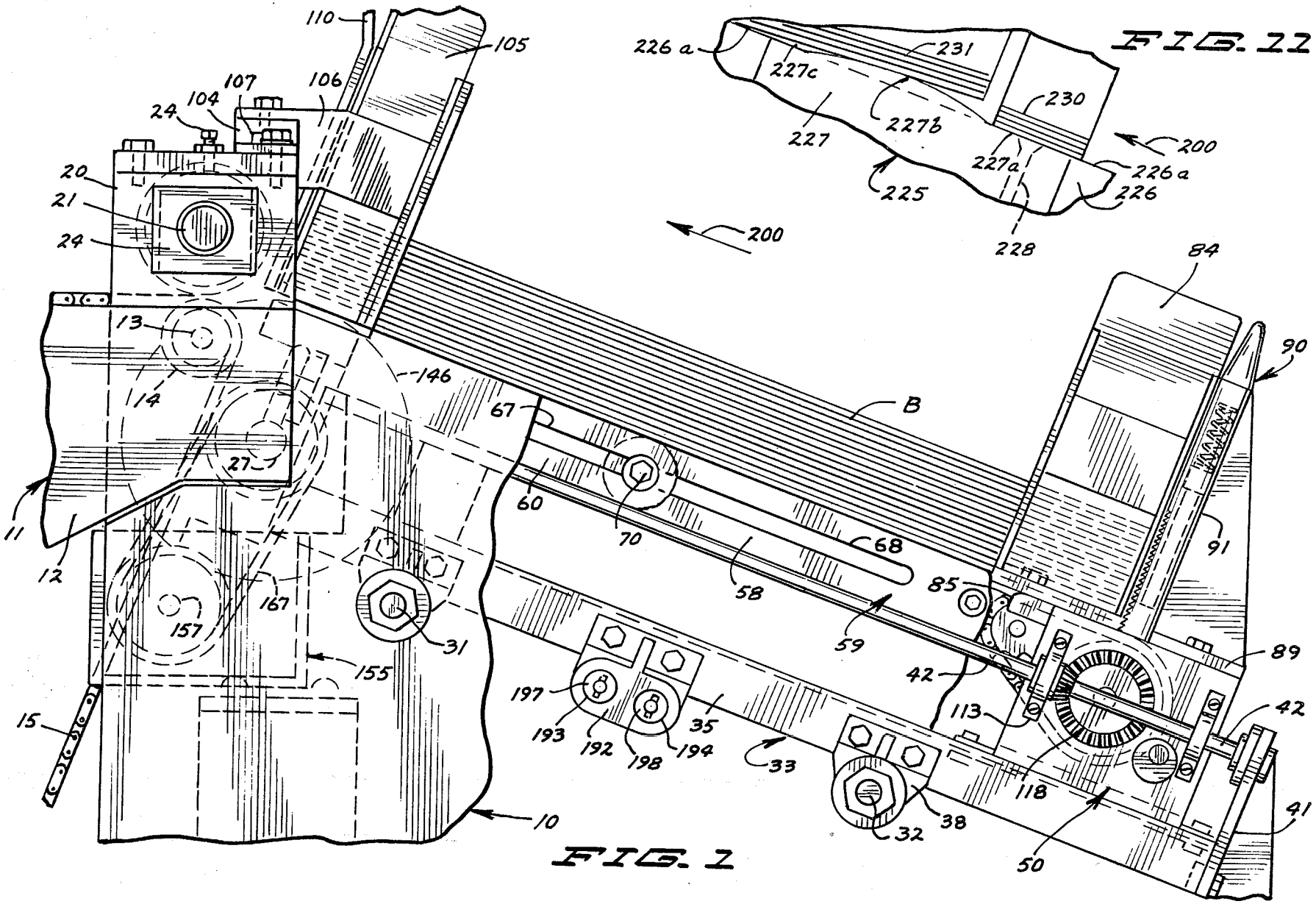
FIG. 2 is a rear, somewhat isometric view of the apparatus of FIG. 1 with only the rear edge of the lowermost blank of a stack of blanks in the machine being shown.
Figure 2:
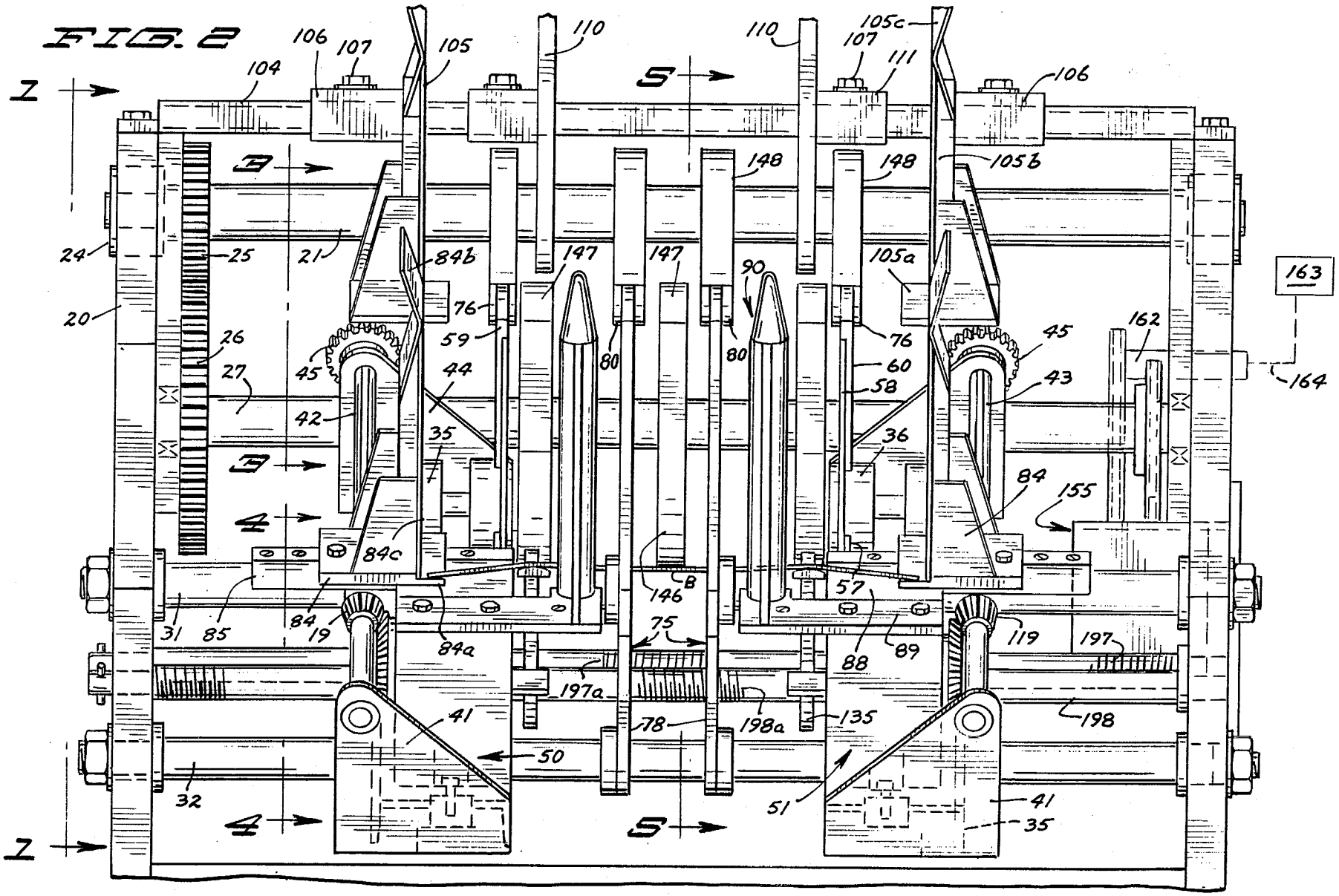

Referring now in particular to FIGS. 1 and 2, the magazine and blank feeder assembly, generally designated 10, of this invention, is designed to feed flat diecut paper board blanks in spaced and timed sequence into a machine, generally designated 11, such as a carton folder/gluer machine, a carton cellophane window machine or other paper board printing or processing machine. The carton folding machine 11 includes a frame 12 that mounts a transverse shaft 13. A plurality of transversely spaced sprockets 14 are mounted on shaft 13, said sprockets having endless carton supporting and feeding chains 15 extended therearound in a conventional manner for feeding a blank forwardly. The carton folding machine may be of conventional construction.

The magazine and blank feeder assembly 10 includes a frame having a pair of transversely spaced plates 20 which mount a pair of transversely spaced shaft mounting boxes 22 for limited vertical movement. Springs (not shown) resiliently urge the boxes upwardly while the upward movement of the boxes is limited by adjustment screws 24. The boxes 22 rotatably mount a transverse shaft 21 which has a gear 25 keyed thereto to be in driven relationship to a gear 26 that in turn is keyed to transverse shaft 27. The shaft 27 is rotatably mounted by the feeder frame plates 20 at a lower elevation and somewhat longitudinally rearwardly of shaft 21. The feeder frame plates mount a transverse support shaft 31 that is located rearwardly and at a lower elevation than shaft 27, and a shaft 32 that is at a lower elevation and a substantial distance rearwardly of shaft 31.

The support shafts 31, 32 mount transversely adjustable mounting sub-assemblies 33 and 34 (see FIGS. 1–3, 5 and 6). The sub-assemblies 33, 34 are supported by the shafts 31, 32 to be selectively transversely adjustably positioned relative one another and the side frame members 20, and retained in the selected adjusted position. Each of the sub-assemblies 33, 34 is of the same construction other than for one is a right hand assembly and the other a left hand assembly; and accordingly, basically only one of the assemblies will be described. Each of the assemblies 33, 34 includes a pair of longitudinally elongated, upwardly and forwardly inclined angle irons 35 and 36 that have upper horizontally extending legs transversely spaced from one another and vertically extending legs 35A, 36A remotely located from one another. Bars 37 are secured to the front and rear ends of the angle irons to retain them in the above mentioned relationship. Each of the angle iron vertical legs mounts longitudinally spaced depending brackets 38 that have bosses through which the respective one of the supporting shafts 31 and 32 is slidably extended to permit the brackets being transversely adjusted along the shafts. To each of the rear bars 37 there is bolted a rear end plate 41 to extend thereabove while to each of the front bars 37 there is bolted a front end plate 44 to extend thereabove. The plates 41, 44 of the sub-assembly 33 rotatably mount the longitudinally elongated shaft 42 while the end plates of the sub-assembly 34 rotatably mount a corresponding shaft 43. The front end of each shaft 42, 43 has an angle gear 45 keyed thereto to be in driven relationship to the respective angle gear 46 that is keyed to shaft 27. The gears 45, 46 are arranged such that when shaft 27 is being rotated in one angular direction, shaft 42 is rotated in the opposite angular direction from the direction of rotation of shaft 43.

The sub-assemblies 33, 34 respectively mount blank kicker assemblies 50, 51 to be retained in selected longitudinally adjusted positions thereon. Each of the kicker assemblies is of the same construction other than one is a left hand assembly and the other is a right hand assembly. A bottom wall 52 of the housing of each kicker assembly is slidably supported on the horizontal legs of the angle irons 35, 36 and mounts front and rear lugs 53 to extend into the space between the adjacent edges of the horizontal legs of said angle irons. Clamp members 54 are provided for cooperating with the lugs and the angle irons to retain the lugs, and thereby the respective housings, in selected longitudinally adjusted positions on the respective sub-assembly 33, 34.

Figures 5, 10:
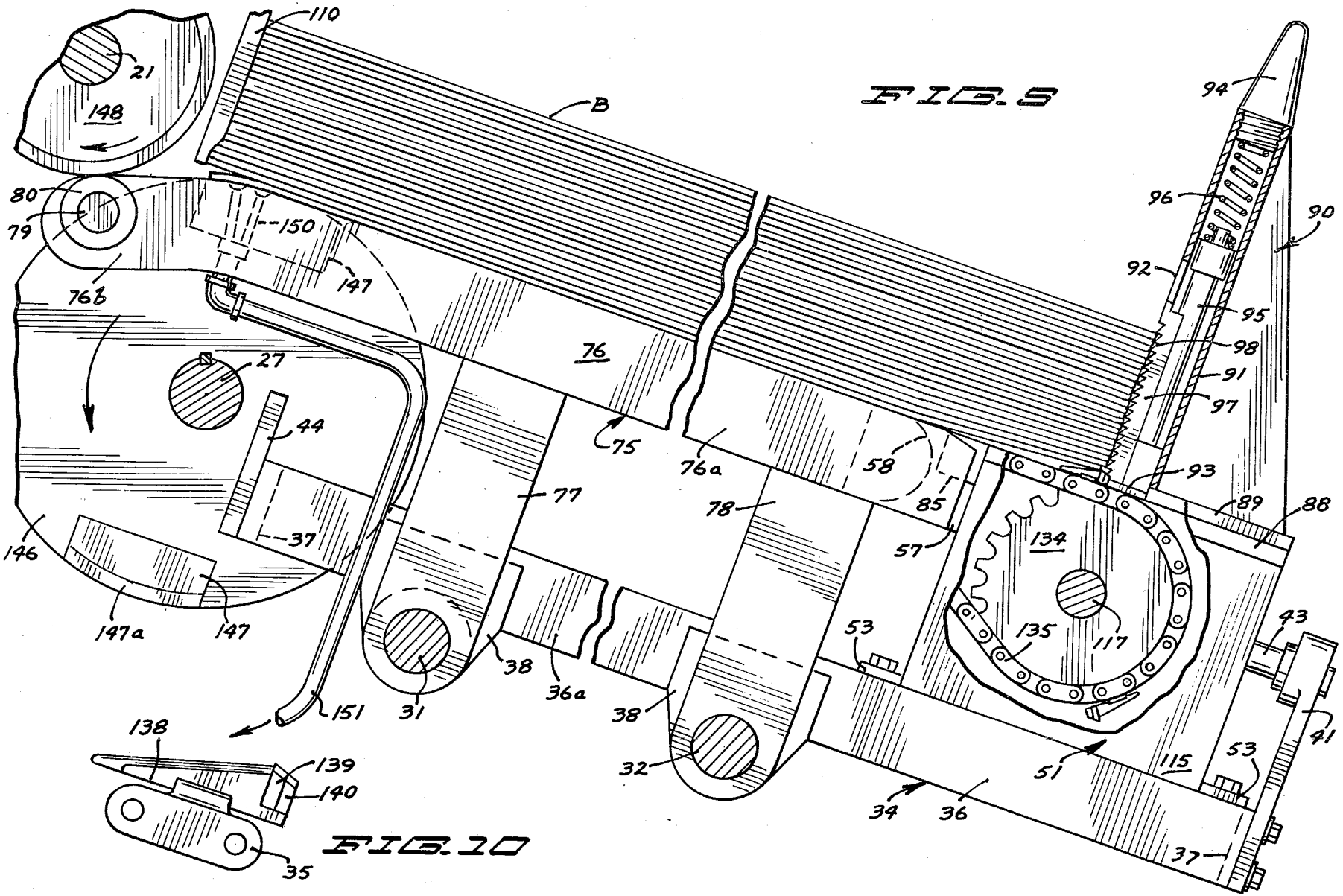
FIG. 5 is a fragmentary, longitudinal, cross-sectional view generally taken along the line and in the direction of the arrows 5—5 of FIG. 2 to more clearly show the mechanism for holding blanks on the blanks support bars and the mechanism for feeding the blanks into the carton folding machine.
FIG. 10 is an enlarged side view showing one of the kicker wedges mounted on a chain link.

The upper front portion of each kicker housing mounts a forwardly extending lug 57 which in turn has the rear end of bar 58 of an adjustable length blank support, generally designated 59, bolted thereto (see FIGS. 1, 3 and 5). Each blank support also includes a longitudinally intermediate bar 60 and a front bar 61. Bar 61 is mounted by being attached to a transversely extending bracket 62, which in turn is attached to the upper portion of the adjacent front end plate 44. As may be noted from FIG. 3, the bar 61 has a rear portion that is inclined downwardly at approximately the same angle of inclination as the respective sub-assembly 33, 34, and a front portion that extends generally horizontally to have a top edge at the same elevation as the supporting runs 15A of the carrier chains 15. The front portion of bar 61 is located at a higher elevation than shaft 27 and extends forwardly thereof. Further, the front portion of bar 61 mounts a transverse stud shaft 64 which in turn rotatably mounts an idler roller 65 on either side of bar 61.

The rearwardly and downwardly inclined rear portion of bar 61 and the front portion of bar 60 are bolted together by a bolt 66. Bars 60, 58 are provided with longitudinally elongated slots 67 and 68 respectively that extends nearly the longitudinal length of the respective bar but does not open through either end of the bar. A bolt 70 is extended through slots 67, 68 for retaining the bars 58, 60 in selected adjusted longitudinal relationship to one another. That is, by loosening bolts 70 and the clamps 54, the respective kicker assembly may be moved, for example, longitudinally more closely adjacent to shaft 27 for feeding shorter length blanks than that would be fed in the position that is being illustrated in FIG. 1, and then tightening said bolt and clamp.

Located transversely between the adjustable length assemblies 59 are a pair of non-adjustable blank support assemblies, generally designated 75 (see FIG. 5). Each assembly 75 includes a longitudinally elongated bar 76 and longitudinally spaced, depending legs 77 and 78 secured thereto. The lower end of leg 77 has a boss through which the shaft 31 is extended while the lower end of leg 78 has a boss through which the shaft 32 is extended. Suitable means, for example, lock bolts (not shown) may be threaded in the bosses for securing the assembly 75 in selected transverse adjusted positions on the shafts 31, 32.

Each of the rear and intermediate portions **76*a* of the bar 76 is suppoted at the same height and has the same angle of inclination as the bars 58, 60 while the horizontally extending front end portions 76*b* of bars 76 are at the same elevation and transversely between the front end portions of bars 61. The forward parts of the front end portions of bars 76 mount stud shafts 79 which in turn rotatably mount idler rollers 80 on the other transverse side of each bar 76 for rotation about an axis coextensive with the axes of rotation of rollers 65**.

For supporting the transverse opposite rear edge portions of the blanks and retaining them in transverse alignment there are provided a pair of oppositely faced alignment brackets 84, each bracket having a generally horizontally extending ledge **84*a* extending inwardly toward the opposite bracket to have the adjacent portion of the lowermost blank in the stack of blanks supported thereon and a generally vertically extending leg 84*c* for abutting against the rear longitudinally extending edge portions of the blanks (see FIGS. 1, 2, 4 and 6). Advantageously, the brackets have upper flange portions 84*b* that are inclined downwardly toward one another at angles to aid in stacking the blanks in the magazine. The brackets 84 are mounted by support bars 85 which in turn are mounted on the housing of the respective kicker assembly 50, 51. As a result, when the bolt 70 for the support bars 60, 58 associated with the respective kicker housing, is untightened and the housing is, for example, moved forwardly from the position of FIG. 1, bar 58 is moved forwardly that same amount, and thence the bolt 70 retightened to retain the bars 60, 58 in the adjusted telescoped position. Thus, the brackets 84** are moved within the housing.

The rear portion of the top wall 88 of each kicker housing mounts a bar 89 to extend transversely toward the other housing; the transverse inner ends of each of the bars 89 mounting a blank hold down assembly, generally designated 90 (see FIGS. 1, 2 and 5). Each hold down assembly 90 includes a generally vertically elongated tube 91 that is mounted by the respective bar 89 to extend above the respective top wall 88 at an angle generally perpendicular thereto. The lower part of each tube includes a vertically elongated slot 92, the lower end of each tube being closed by a closure 93 that abuts against the top wall, and the upper end being closed by a closure 94 that is advantageously threadingly secured to the tube. The closure 94 has a generally conical outer surface that is tapered to facilitate the loading of blanks into the magazine.

Vertically slidably mounted within the tube is a plunger 95. A coil spring 96 has one end seated against the plunger and an opposite end against the closure 94 for resiliently urging the plunger 95 in a downward direction. The plunger mounts a vertically elongated hold down member 97 to have the serrations 98 thereof extend outwardly in a forward direction through the slot 92. Each serration is inclined downwardly and forwardly, and thence rearwardly at an angle substantially parallel to the top wall whereby the hold down member may move upwardly relatively easily while bearing against the rear edges of the blanks in the magazine; but exert a substantial downward pressure on the blanks rear edge portions as will be more fully described hereinafter. The lower edge of the hold down member is abuttable against closure 93 to limit the downward movement thereof, while the slot 92 is of a length that the hold down member may be moved a substantial distance above closure 93 and still have the serrated edge protrude outwardly through the slot 92.

For supporting and retaining the front portions of the blanks in vertical alignment, the magazine includes a transversely elongated track 104 mounted on frame members 20 generally vertically above shaft 27 (see FIGS. 1 and 2). Mounting brackets 106 are adjustable, slidably mounted by the track and retained in transverse adjusted positions by slide clamps 107. Each of the brackets 106 mounts an alignment and support bracket 105. The brackets 105 are of the same construction other than that one is a left hand bracket and the other is a right hand bracket. Each bracket 105 includes a support ledge 105A for supporting the adjacent front longitudinal edge portion of the lowermost blank in the stack, a generally vertical leg 105B for abutting against these longitudinally extending edges of the blanks, and an inclined flange 105C that is sloped at an angle to aid in directing or loading blanks into the magazine.

A pair of mounting members 111 are selectively adjustably positioned transversely along the track 104 and retained in selected adjusted positions between mounting brackets 106 by slide clamp members 107. Each of the mounting members 111 mounts a vertically extending escape bar 110, the upper portion of the escape bar being at an angle to the lower portion for aiding the loading of the magazine. The top surfaces of ledges 84A and 105A are located in, or substantially in, a common plane, while the escape bars lower edges terminate at substantially an intersection thereof with said plane. Further, the lower portions of the escape bars, the transversely adjacent surfaces 84C of brackets 84, and the transversely adjacent vertical surfaces of bracket portions 105B extend substantially perpendicular to said common plane. Additionally, the top edges of the intermediate and rear portions of bars 58, 60, the rear portions of bars 59, and portions 76a of bars 76 are located in or closely adjacent said common plane. The aforementioned common plane is inclined upwardly in a forward direction, advantageously at an angle of about 20° relative the horizontal. Members 84, 90, 105, 110 comprise a magazine for retaining a stack of flat folded blanks in proper alignment on the slide support mechanism 58, 60, 76; while the upper inclined portions of the magazine facilitate loading the blanks thereinto.

Figure 4:
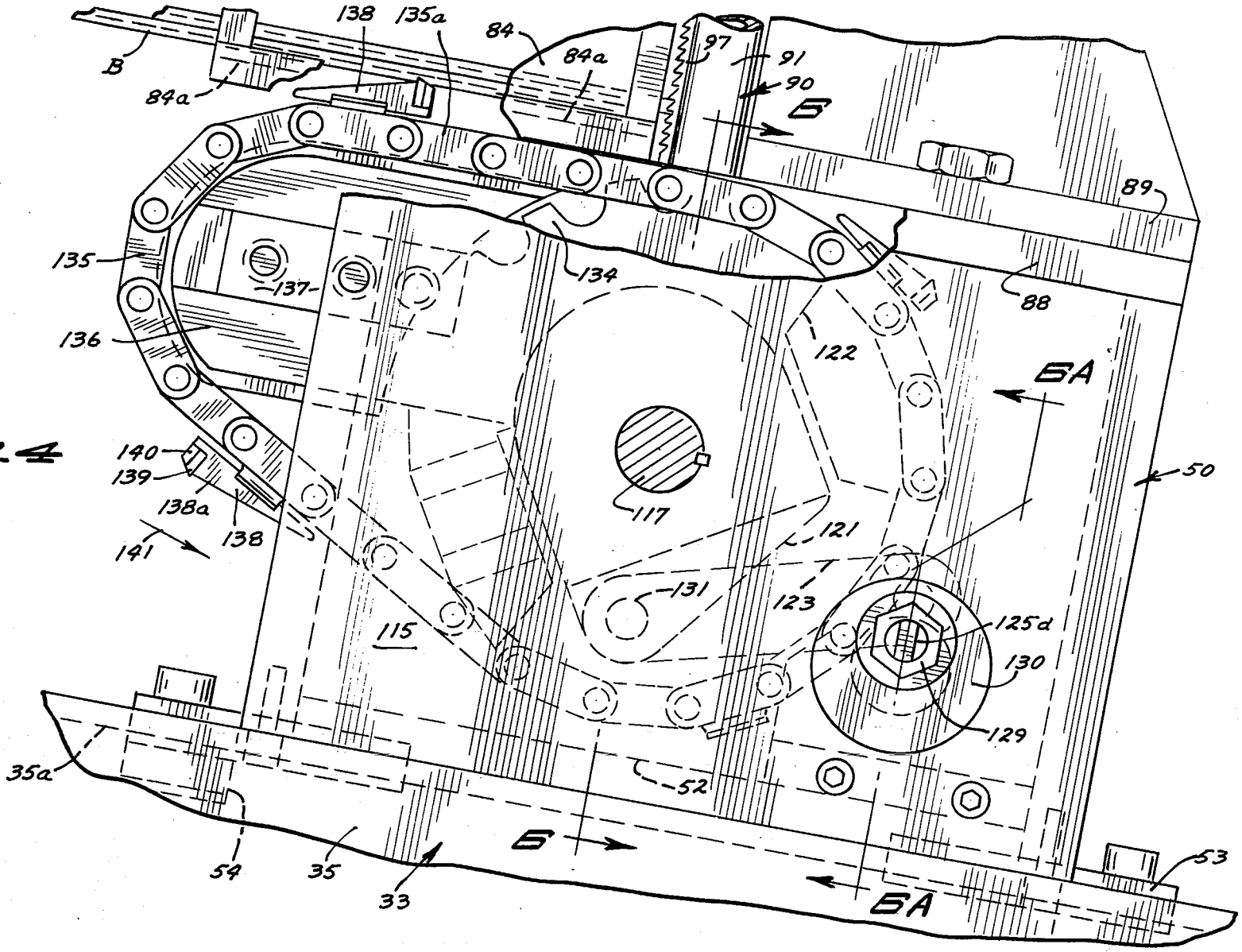
FIG. 4 is a fragmentary, longitudinal sectional view generally taken along the line and in the direction of the arrows 4—4 of FIG. 2 to more clearly show one of the blank kicker assemblies.
Figure 6:
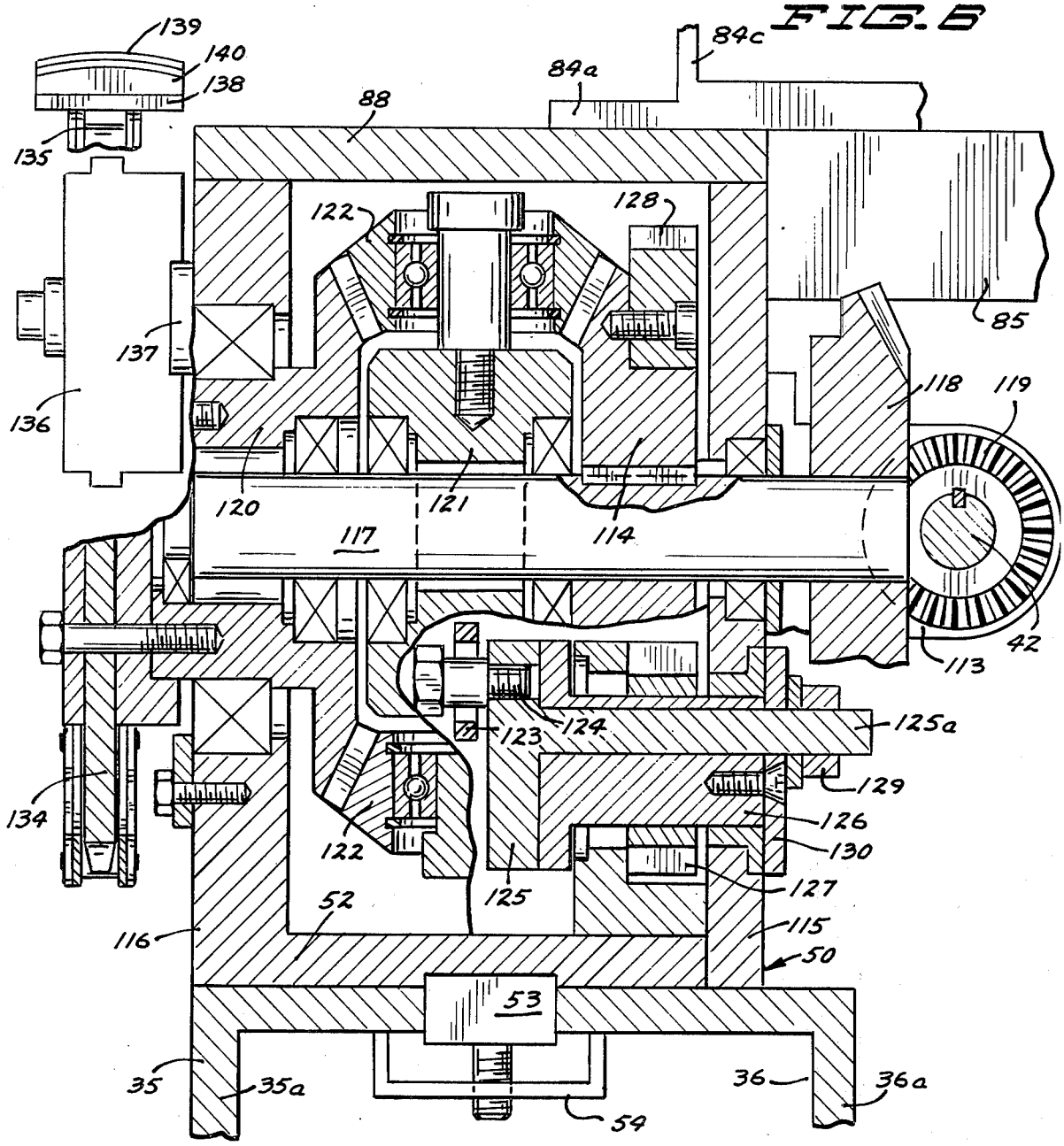
FIG. 6 is a transverse cross-sectional view of the structure of FIG. 4, said view in part being generally taken along the line and in the direction of the arrows 6—6 of FIG. 4, and in part in the direction of the arrows 6A—6A of FIG. 4.

Turning now in particular to FIGS. 4 and 6, each kicker assembly includes a housing having side walls 115 and 116, side wall 115 in part rotatably mounting a transversely elongated shaft 117. The shaft 117 extends exterior of the housing remote from the other housing whereat the shaft has a bevelled gear 118 keyed thereto to be in driven relationship to a bevelled gear 119. The bevelled gears 119 are mounted on shafts 42 and 43 respectively and are positioned together with the orientation of the respective bevelled gear 118 being such that both of the shafts 117 are rotated in the same angular direction as shaft 27 is rotated. Further, each shaft 42, 43 has an axially elongated key way to axially slidably receive gear 119 while each bevelled gear 119 is rotatably mounted by a bracket 113 to be moved forward and rearwardly therewith. The brackets 113 are bolted to the respective kicker housing whereby whenever the housing is adjustably positioned along the length of the respective sub-assembly 33, 34, the gear 119 associated therewith is axially moved along the respective shaft 42, 43 while remaining keyed thereto. Thus, the bevelled gears are maintained in the same relationship to gears 118 whenever the kicker housings are longitudinally adjustably positioned on the sub-assemblies 33, 34.

The side wall 116 rotatably mounts a bevelled gear 120 which has one end portion of shaft 117 extended thereinto with gear 120 being rotatable relative the shaft 117. Within the housing, a bevelled gear 114 is keyed to shaft 117. A cage member 121 is rotatably mounted on shaft 117 transversely between gears 114, 120 and rotatably mounts oppositely disposed bevelled gears 122 for transmitting a driving force from gear 114 to gear 120 when gear 114 is rotated relative cage 121.

A link 123 at one end is pivotally connected by a pivot member 124 to an eccentric 125, the opposite end of the link being pivotally connected at 131 to the cage 121 at a substantial distance radially spaced from shaft 117. The shaft 125A of the eccentric 125 is rotatably supported by an eccentric mount 126 such that the shaft axis is radially offset from the central axis of the mount 126 and parallel to the axis of shaft 117. Side wall 115 mounts mount 126 for rotation about an axis parallel to shaft 117. A gear 127 is keyed to mount 126 and is in driven relationship to the gear 128 that is keyed to gear 114. A nut 129 is threaded onto the end portion of the shaft 125A exterior of the housing for abutting against a washer 130 to retain the shaft 125A in a selected rotated angular relationship to eccentric mount 126, the washer being retained in a fixed angular relationship to mount 126. The shaft 125A has a screw driver slot external of the housing whereby the nut 129 may be loosened and shaft 125A rotated relative mount 126, and then the nut tightened to retain the shaft in the adjusted angular position relative the mount. By making this type of an adjustment, the radial spacing of the pivot axis of pivot member 124 from the axis of rotation of mount 126 and gear 127 may be varied to therethrough vary the maximum acceleration and deceleration of gear 120 when shaft 117 is being driven.

Located exterior of the housing is a sprocket 134 that is mounted on gear 120 to be driven thereby. An endless chain 135 is extended around sprocket 134 and chain attachment 136 whereby the chain is driven by said sprocket. The chain attachment extends forwardly of the respective assembly housing and is mounted by a bar 137 which in turn is secured to the housing. The chain attachment and sprocket mount the chain to have an upper run that extends substantially parallel to the upper edges of support bar portions 76*a*, and the upper run to terminate at a forward location that is a substantial distance rearwardly of the escape bar. However, the upper run is of a length that is greater than the longitudinal distance from the rear part of the escape bars to the entry nip between rolls 148, 80, and of a sufficient length to move the front edge of a blank from the escape bars to a position to be further moved forwardly by the carton feeding machine before a kicker ledge 139 on the upper run moves below the plane of the upper run.

A plurality of kicker wedges 138 are mounted by the chain 135 to be spaced the same distance along the chain from one another. Each wedge 138 has a ramp surface 138*a* that is inclined toward the chain in the direction of movement (arrow 141) of the chain, each ramp surface terminating at a kicker ledge 139 to extend further outwardly from the chain than the ramp surface 138. As may be noted from FIG. 6, the top surface of the wedge and ledge are rounded to have the transverse intermediate portions thereof further spaced from the chain than the transverse end portions. A kicker block 140 is mounted by a wedge to aid in retaining the ledge in the proper position. To be noted is that as the kicker ledge and wedge are moved along the upper run 135*a* of the chain, said ledge extends to a higher elevation than the common plane of the top surfaces of ledges 84A and 105A while the forward part of the ramp surface extends to a lower elevation than said common plane. At the abutting faces of wedge and ledge that extend outwardly of the chain, each transverse segment of the ledge longitudinally adjacent a corresponding segment of the wedge extends further outwardly from the chain than the wedge by a distance slightly less than the thickness of the blank B.

Advantageously, the longitudinal end portion of the wedge remote from block 140 is arcuately curved so that the transverse central portion thereof extends longitudinally further remote from block 140 than either transverse side thereof.

By gently curving the wedge ramp surface, and the ledge and block 140 surfaces that are remote from the chain so that the transverse central portions thereof extend further away from the chain than the transversely adjacent parts on either transverse side of the central portions, these members are shaped more nearly to the natural curve of the blanks (gravity caused droop of the blank stack after the stack has been raised locally by the preceding wedge) to permit a more positive engagement of the ledge with the rear edge of the lowermost blank in the stack than if such a curved configuration were not provided.

Referring now in particular to FIGS. 1–3 and 5, a plurality of large diameter picker feed rolls 146 are keyed to shaft 127 in transverse spaced relationship to one another. Each feed roll 146 has a pair of diametrically opposed inserts 147 that has a circumferential outer surface portion 147A made of material such as rubber, while the circumferential portion of the wheel 146 other than for said inserts, is made of a material such as polished steel. One feed roll is located vertically beneath each of the escape bars 110 such that a perpendicular radius of curvature of the respective feed roll intersects the lower edge of the escape bar. Further, each feed roll extends to a slightly higher elevation than the horizontally extending top surfaces of the front portions of bars 76 and 61 adjacent the juncture of the front portion of bar 76 with the intermediate portion thereof and the juncture of the front portion 61*a* with the rear portion of bar 61, and transversely adjacent thereto. These junctures are curved about radii of curvature that are about the same as the radii of curvature of rolls 146 so that the curved portions of said bars are located slightly closer to the axis of rotation of shaft 27 than the outer circumferential surfaces of the rolls. Advantageously, one roll 146 is mounted transversely between bars 76, one between the left hand bar 76 and bar 61, and another between the right hand bars 76, 61.

Keyed to shaft 21 are a plurality of pull rolls 148 that are of substantially larger diameters than rollers 65, 80, and substantially smaller diameters than rolls 146, there being one feed roll 148 above the front end portion of each of the blank bottom supports and transversely positioned to be vertically above the rollers (65, 80) that are mounted by the respective support. These rollers 80, 65, and roller 148 provide an entry nip that is located forwardly of the most closely adjacent parts of escape bars 110 and rollers 146 and transversely offset relative thereto. For pulling the front end portion of the lowermost blank being supported by the blank supports and ledges 84A, 105A to a sufficiently lowered elevation to pass between the escape bars and the wheels 146, each of the front end portions of the blank support bars 76, 61 is provided with vacuum channels 150 that open through the top surfaces thereof, said channel openings being located longitudinally a slight distance rearwardly of the lowermost portion of the escape bars and adjacent the juncture of the bars front end portions with their inclined portions. Conduits 151 are fluidly connected to the channels 150 and to a vacuum pump (not shown) that is mounted on the machine. Since the upper surfaces of the blank support bars are polished, the blanks can slide freely therealong even though the vacuum retains the adjacent part of the lowermost blank in abutting relationship with the top surface of the respective support.

Figures 7, 12:
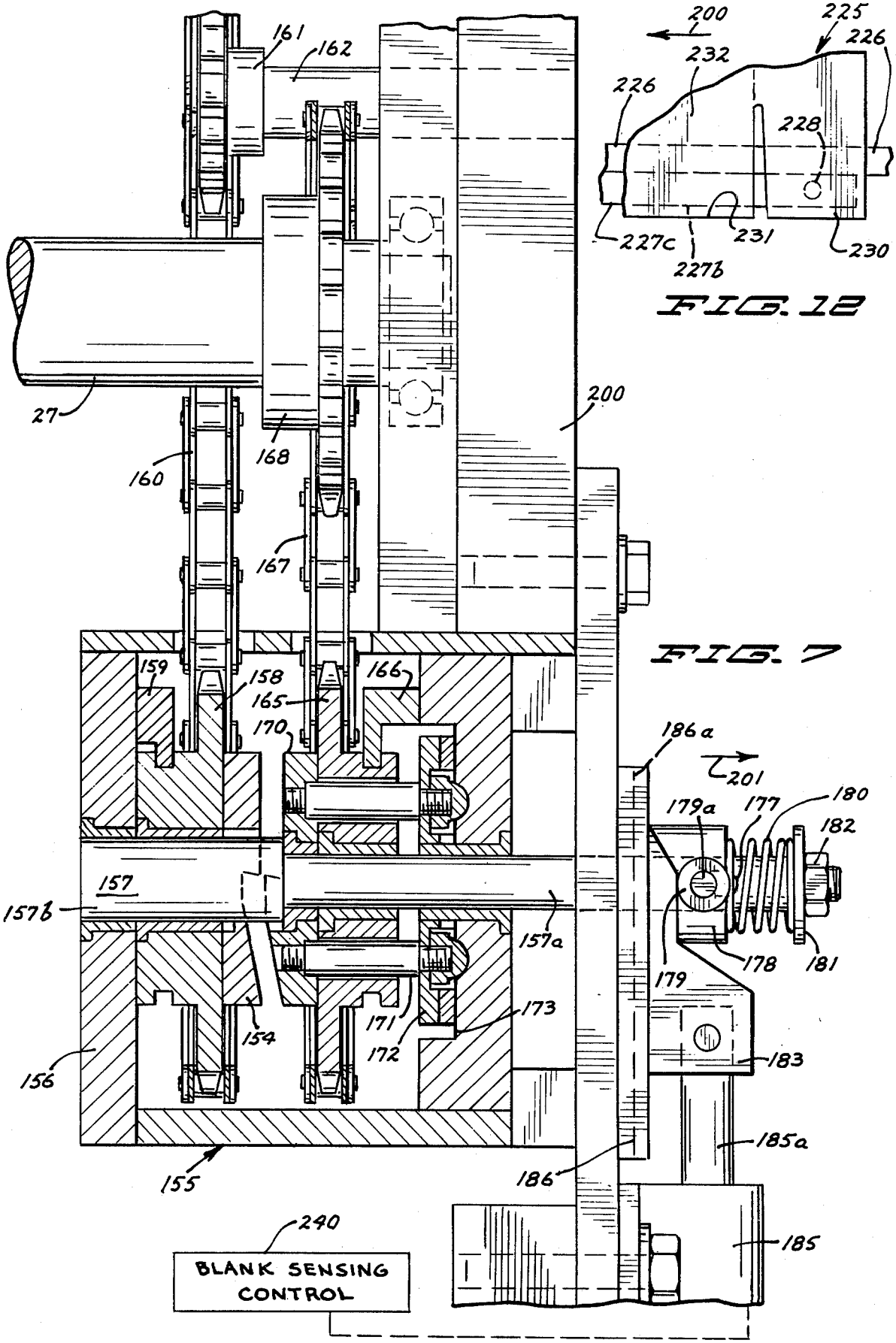
FIG. 7 is a transverse sectional view, part in cross-section, of the clutch assembly and the structure operatively connected thereto.
FIG. 12 is a fragmentary plan view of the structure of FIG. 11.

Referring now in particular to FIGS. 7 and 8, the clutch assembly, generally designated 155, includes a housing 156 that mounts a transversely elongated shaft 157 for limited transverse movement relative thereto. The shaft is mounted in a manner to preclude rotation thereof relative the housing. Further, the shaft has an enlarged diametric end portion 157B, and a transversely elongated smaller diameter portion 157A that intersects with portion 157B to provide an annular shoulder 157C.

Rotatably mounted within the clutch housing and on shaft portion 157B is a sprocket 158 that has a drive clutch dog 154 secured thereto to rotate therewith. A sprocket retainer 159 is mounted on the housing and extended into an annular groove of the sprocket 158 to retain the sprocket in a given axial position relative the shaft 157. The sprocket 158 is driven by an endless chain 160 that extends through an appropriate aperture in the housing top wall and around a sprocket 161 that is keyed to a shaft 162 which is rotatably mounted on one of the plates 20. A suitable mechanical drive connection 164 is provided between shaft 162 and the drive 163 of the carton folding machine so that the shaft 162 is constantly driven in synchronism with the endless conveyors 15.

Rotatably mounted on the diametric portion 157A of shaft 157 is a driven sprocket 165, the sprocket having an annular groove into which the sprocket guide 166 extends for retaining the sprocket in a given axial position. The guide 166 is mounted by the clutch housing. The sprocket 165 drives an endless chain 167 that extends through an appropriate aperture in the clutch housing top wall to drive a sprocket 168 that is keyed to the shaft 27. Transverse clutch pins 171 are slidably extended through sprocket 165 and mount a driven clutch dog 170 axially between a drive clutch dog 154 and sprocket 165. The dog 170 is axially movable between a disengaged non-driving position with dog 154 and a position in driven engagement therewith. The end portions of the pins 171 opposite dog 170 mount a brake disc 172 that is extendable into a housing recess 173, and when in abutting engagement with the wall that in part defines said recess, acts to very quickly brake the rotation of the sprocket 165. Springs 175 are seated in recesses in the sprocket 165 and bear against the clutch dog 170 for constantly resiliently urging the dog axially toward the dog 154, and accordingly therethrough urging the clutch pins to move the brake 172 out of braking engagement with the recess 173. Thus, the springs 175 retain the dog 170 in abutting engagement with the shoulder 157C.

The shaft portion 157A extends exterior of the clutch housing and through a vertically elongated track 186 that is mounted on the frame, the outer end of the shaft having a reduced diameter threaded end portion on which a nut 182 is threaded for retaining a washer 181 in abutting engagement with the shoulder formed by the threaded end portion and the adjacent part of portion 157A. A coil spring 180 has one end abutting against washer 181 and an opposite end abutting against an actuator block 178 for resiliently urging the block toward the track 186 and the shaft toward a position for disengaging the dogs 154, 170. Shaft portion 157A has an elongated slot 177 through which a pin 179A is slidably extended, the pin mounting a pair of rollers 179 on either side of the block 178. The pin is rotatably mounted by a block 178 in a manner that both the pin and block move transversely together. Mounted for vertical movement by the track 186 is an actuator slide 183, slide 183 having bifurcated legs that extend one on either side of block 178. The aforementioned legs extend one on either side of the block 178 and have upper end portions that are inclined at an angle such that the slide is moved from its lowermost position to the position illustrated in FIG. 7, the rollers 179 and block 178 are moved axially away from the sprocket 158 and through spring 180, the shaft 157 to move transversely in the direction of arrow 201 to the FIG. 7 position. The track has a vertically extending slot 186A in which the slide movably extends, and when the slide is in its lowermost position, block 178 is movable axially into the slot (in a direction toward the sprocket 158) from the position illustrated in FIG. 7. The spring characteristics of springs 180 and 175 are such that when the block 178 abuts against the slot surface of slot 186A remote from nut 182, the springs 175 force the dog 170 to move axially into driving relationship with dog 154 and axially move the shaft 157 to permit the aforementioned movement of the dog 170. As the dog 170 is moved into driving relationship with dog 154, the brake member 172 is moved out of braking engagement with recess 173. However, when the slide 183 is moved upwardly to its uppermost position, shown in FIG. 7, the actuator block 178 moves outwardly to compress spring 180 and accordingly cause the shaft 157 to move to a position that dog 170 is out of driving relationship with dog 154.

For moving the slide 183 between its upper and lowermost positions, it is attached to a solenoid operated member 185A of the solenoid 185 to move therewith. The solenoid may be operated by suitable controls 240 that sense the lowermost blank being moved out of the magazine sufficiently to be movingly engaged by the carton folding machine and thence operate slide 183 to its uppermost position to thereby disengage dog 170 from dog 154, and also upon sensing the blank fed into the carton machine, operate the solenoid to move slide 183 to its lowermost position.

The dogs are disengaged and sprocket 170 is braked to a stop in an angular position that a wedge 138 on each of the upper runs of chains 135 have the forward parts of their ramp surfaces beneath and spaced from the rearward edge portion of the lowermost blank B of the stack in the magazine and longitudinally intermediate parts of the ramp surfaces about to engage the lowermost blank to elevate the adjacent part of the blank when the wedges are moved forwardly. At this time the wedges of the preceding sentence have their ledges a slight distance rearwardly of the rear edge of the lowermost blank, while all of the other wedges on the chains 135 are out of contact with the lowermost blank. Thus, hold down members 97 hold the rear portions of the stack of blanks in their rest position to permit nearly instant engagement of the wedges on the upper runs of chains 135 with the rear edge of the lowermost blank in the stack as soon as the chains are started to be driven. Each time the drive to the kicker assemblies is stopped, one wedge on each chain 135 is relative the then lowermost blank in the stack as above described.

Due to the constant downward urging of hold down members 97 and gravity, as the wedges initially move in a forward direction relative the blanks, the adjacent rear edge portions of the blanks are urged to a position that there is a positive engagement between the rear edge of the lowermost blank and the ledges before the blank is moved forwardly. This provides for the blank being moved in proper timed relationship to the machine being fed.

The continuing downward pressure on the rear edges of the stack of blanks results from a downward ratcheting effect of the blank stack which is gravity pressed against the downwardly spring loaded hold down members 97. The wedges intermittently raise the rear part of the stack against the spring loaded hold down member while gravity and the spring loading then return the stack downwardly and the stack downwardly overtravels the thickness of one blank.

For transversely adjustably positioning the sub-assemblies 33, 34 there is provided a pair of parallel transverse shafts 197, 198 that are rotatably mounted by the frame plates 20, in fixed axial positions. As viewed in FIG. 2, the left hand portion of shaft 198 is threaded up to line 198A and is extended through a threaded aperture 194 in brackets 192 that are dependingly secured to sub-assembly 33. The left hand end portion of shaft 197 up to line 197A is nonthreaded, and is extended through nonthreaded apertures 193 in brackets 192 that are secured to assembly 33. The brackets 192 that are secured to assembly 34 are oppositely faced from those secured to bracket 33 such that the threaded apertures 194 are forward of the nonthreaded apertures 193 instead of the reverse as shown in FIG. 1 for sub-assembly 33. Thus, the apertures 194 of the brackets of sub-assembly 34 have the threaded portion of shaft 197 extended therethrough and the nonthreaded portion of the shaft 198 extended through apertures 193. A suitable crank (not shown) may be provided for rotating the respective one of the shafts 197, 198; the shaft 197 being provided for transversely adjustably positioning assembly 34, and the shaft 198 may be provided for transversely adjustably positioning the sub-assembly 33.

By rotating shaft 198 in one direction; and depending on the direction of transverse adjustment, before or after rotating the shaft, moving the appropriate gear 46, the sub-assembly 33 and the structure mounted thereon is transversely translated. After the position of sub-assembly 33 is adjusted the gear 46 is axially slid along shaft 27 to intermesh with the proper gear 45. Since shaft 27 has an axially elongated keyway, gear 45 is retained in the same relative angular position on the shaft during the transverse adjustment thereof.

Figure 9:
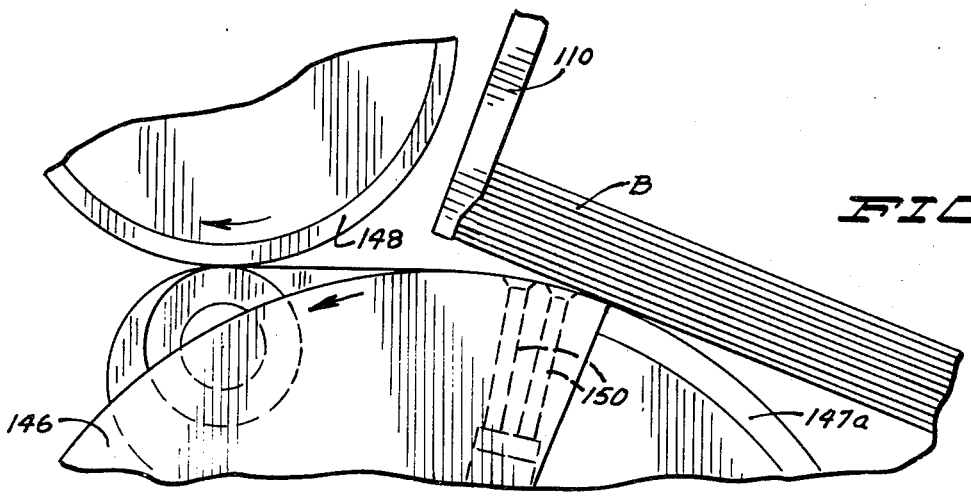
FIG. 9 is a fragmentary longitudinal sectional view of a portion of the structure for directing the forward part of a blank into the carton folding machine.

To aid in separating the blanks from one another, advantageously the lower rear surface portions of each of the escape bars is provided with a surface that is curved downwardly to extend in a forward direction such as shown in FIG. 9 whereby when the lowermost blank in the magazine is abutting against the escape bar, it extends a slight distance forwardly of the blanks vertically thereabove.

Referring now in particular to FIGS. 11 and 12, there is illustrated a modified embodiment of the bottom blank support bar mechanism, generally designated 225, that includes a longitudinally elongated support bar 226. Attached to the support bar is an auxiliary bar 227. Preferably bars 226, 227 are attached in a manner that the longitudinal position of bar 227 can be readily longitudinally adjusted relative bar 226, for example, a slot in one bar and bolts extended through the slots. Bar 227 has an upper edge portion 227*a* that is at substantially the same elevation as the transverse adjacent part of the top edge portion 226*a* of bar 226 and parallel thereto, a smoothly curved, longitudinally intermediate edge portion 227*b* that in the longitudinally forward direction of arrow 200 progressively extends to slightly higher elevations that the transverse adjacent parts of edge portion 226*a* and thence progressively to be at the same elevations as the adjacent parts of edge portion 226*a* and a front edge portion 227*c* that is parallel to and substantially at the same elevations as the transversely adjacent parts of edge portion 226*a*. One or more vacuum channels are provided in bar 227 to open through edge portion 226*a* longitudinally spaced from edge portion 227*b*.

The structure of FIGS. 11 and 12 is particularly suitable with blanks hooky die cuts edges where a transversely extending cut or notch provides a tab end portion 230 that is longitudinally separate from blank portion 231 and portions 230, 231 are joined to transversely adjacent parts of the same blank. That is, bar 227 is to underly the end tab portion 230 and the longitudinally intermediate tab portion 231 transversely on the opposite side of bar 226 from the blank main body 232 with port 222 opening to the lowermost tab 230 and end portion 227*b* underlying the longitudinally adjacent part of tab portion 230. As a result, the blank portion 231 of the next to the lowermost blank in the stack is supported at a sufficiently high elevation that as the lowermost blank is moved forwardly the tab 230 of the lowermost blank will not lock against the rear transversely extending edge of the blank portion 231 of the next to lowermost blank, the vacuum in channels 228 holding the lowermost tab 230 down as the blank moves forwardly. In this connection, the top edges of bars 227, 226 are advantageously of polished metal.

It is to be understood that if the blank has a tab transversely opposite tab 230, then there would be provided bars 226, 230 therebeneath with the two bars 226 transversely adjacent. Similarly, if the front portion of this blank has front tab portions 230, then a second bar 227 is provided on bar 226 that has the vacuum port forwardly of curved portion 227b instead of rearwardly thereof such as shown in FIG. 11. Further, if the adjacent parts of the front tab 230 and tab portion 231 overly the curved junction of, for example, bar portion 61*a*, then bar 227 would be mounted on bar 61 and modified to have edge 227*a* extend horizontally at the same elevation as the horizontal top edge of bar portion 61*a*, edge 227*c* inclined to extend at the same angle as the top inclined edge of portion 61*b* and at the same elevation as the transversely adjacent parts thereof and portion 227*b* curved to extend to slightly higher elevations than the juncture of portions 61*a*, 61*b*. Thus, edge portions 227*b* of modified auxiliary bars 227 mounted on bars 61 would at least in part extend above the common plane of the top edges of bars 60 as would the edge portions 227*b* of bar 227 mounted on the rear portions of bar 43. In this connection, it is to be noted that brackets 84 can be bolted on bars 85 in any one of a number of transversely adjusted positions so that the rear tabs 230 can be properly oriented with reference to bars 43. Thus, bars 227 appropriately modified, if necessary, can be mounted on bars 76, 43, 61, or on bars 227 which can have front end portions corresponding to front portions 76*b* and mounted on shafts 31, 32 in the same manner that bars 76 are mounted on said shafts.

In using the apparatus of this invention with the kicker assemblies being selectively longitudinally spaced from the shaft 27 for the appropriate length blanks, and the alignment brackets 105, 84 being appropriately transversely spaced, and a stack of flat folded carton blanks being supported by the magazine, the carton folding machine is turned on. For purposes of facilitating the description of operation, it will be assumed that the upper run of each kicker chain is in a position that one of the kicker ledges is just immediately rearwardly of the rear transverse edge of the lowermost blank in the magazine and the ramp surface of the respective wedge is out on contact with the blank.

At the appropriate time for another blank to be fed into the carton folding machine, a signal is sent to the solenoid 185 to operate it for moving slide 183 to its lowermost position, and as a result, the dog 170 is moved into driving engagement with dog 154. This initiates the rotation of shaft 27 which in turn rotates gears 45 for turning shafts 42, 43. The rotation of shafts 42, 43 through gears 119 drive gears 118 and thereby shafts 117. Shafts 117 drive gears 114, 128. Due to the angular position of eccentrics 125, cage members 121 are moved such that the drive from gear 114 through gears 122 to gears 120 accelerate the rotation of sprockets 134, and thence decelerate the rotation of sprockets 134. That is, as gears 127 are rotated, the eccentrics are rotated to through links 123, first pivot the cage members about shafts 117 in one angular direction, and thence in the opposite angular direction.

As the sprockets 134 start to rotate, the kicker wedges adjacent the rear transverse edge of the lowermost blank on the magazine are moved forwardly beneath the lowermost blank to force the rear edge portion thereof upwardly against the action of the hold down members 93, and upon their kicker ledges abutting against the rearward edge, move the lowermost blank forwardly in the direction of arrow 200. At the same time, the drive to sprocket 25 rotates the shaft 21, and thereby the feed wheels whereby rubber insert portions thereof intermittently engage the adjacent forward part of the blank to help pull the lowermost blank forwardly; it being noted that the vacuum tube channels 150 retain the forward end portion of the blank down against the bottom blank supports to permit only the lowermost blank moving forwardly beneath the escape bars 110. The primary force for moving the lowermost blank forwardly is exerted by the kicker ledges, and thereafter by the carton folding machine.

After the lowermost blank has been moved forwardly sufficiently to be between the entry nip of rollers 148, 65, 80 the eccentric 125 has been moved to a position to decelerate the drive from gear 114 to gear 122. At this time, the rollers 148, 80, 65 continue to move the lowermost blank forwardly in a direction to remove it from the magazine. As soon as the wedges that engaged the lowermost blank have been moved forwardly a sufficient amount to be moved out of engagement with the then lowermost blank in the stack and the next rearwardly wedge being moved to a position to be transversely between the hold down tubes 91 (closely adjacent the rear edge of the then lowermost blank), slide member 183 is operated to its uppermost position whereby shaft 157 is moved in the direction of the arrow 201 and the clutch dog 170 moved out of driving engagement with dog 154. The brake 172 in moving into engagement with recess 173 stops sprocket 165 and accordingly terminates the drive to the kicker assemblies and the wheels 146. At the first time the insert on wheels 146 are in position to engage the then lowermost blank in the stack, while the carton folding machine can continue to withdraw the blank that had been fed between rollers 146, 80. When the blank that was between rollers 148, 80 has been moved forwardly thereof, the solenoid 185 is again operated whereby dog 170 moves into driven engagement with dog 154, and another blank is fed from the magazine as previously described.

The clutch dogs are disengaged and stopped in relative positions that after one pair of wedges have pushed the lowermost blank forwardly, the following pair of wedges on the chains are in the same relative positions to the rear edge of the then lowermost blank that the preceding wedges were to the prior lowermost blank at the time the dogs were engaged to move the prior blank forwardly. Thus, the registry between the apparatus of this invention and the carton folding machine is maintained. The solenoid controls may incorporate an electric eye mis-feed sensing system to stop only the feeder apparatus while permitting the carton folding machine to continue running.

Prior to the clutch assembly being moved to its dog disengaged condition, the lowermost blank has been moved into the carton folding machine so that even though the drive to shaft 27 is discontinued, the blank is pulled forwardly by said folding machine in a conventional manner. Due to the boxes 24 being mounted for limited vertical movement the blank can be pulled beneath rolls 146 even though said rolls are not being rotated.

The eccentrics 125 are adjusted so that the blank being fed from the bottom of the stack is smoothly accelerated by the ledges engaging the rear edge thereof up to a speed that is substantially the same as the linear speed that it is subsequently moved by rolls 148, 80, 76, and at the time the front edge portion of the blank enters the entry nip between said rolls is moving at said linear speed, and after the blank is being pulled forwardly by said rolls, said ledges are decelerated.

The apparatus of this invention is particularly suitable for feeding blanks at steady rates which can be varied from 60 blanks per hour to 36,000 blanks per hour; and in model can be adjusted for feeding blanks of longitudinal lengths from 6 to 48 inches. Further, the apparatus can be used for feeding paperboard blanks of thicknesses from about 8 mils to about 42 mils. The minimum thickness is limited by the kicker ledges being able to positively engage the rear edge of only the lowermost blank while the maximum thickness is limited by the bending characteristics of the blank. That is, the blanks have to be able to have the front end portions pulled down by the vacuum applied through ports 150 sufficiently to clear the escape bars. Additionally, the apparatus of this invention can be used in conjunction with, for example, inline infold gluers and right angle gluers, and can be used for handling various cut blanks, for example, Beers style infold blanks, Brightwood infold or outfold blanks, bottle carrier blanks, automatic bottom type blanks. The blanks need not be rectangular or square.

What is claimed is:

1. For successively feeding the lowermost blank from a generally vertical stack of blanks, one after another, in a longitudinally forward direction into a processing machine such as a carton folding machine wherein the blanks in the stack have a transverse notch or slit providing tabs and blank portions extending longitudinally adjacent thereto with the tabs and blank portion of the blanks in the stack respectively being above one another, blank feeder apparatus comprising a frame, longitudinally extending slide means on the frame for supporting the stack of blanks, means on the frame for feeding the lowermost blank in the stack forwardly along the slide means into the processing machine, means on the frame and adjacent the front of the stack of blanks for blocking the movement of the stack of blanks other than the lowermost blank to said machine, and hold down means on the frame for constantly resiliently urging rear end portions of at least the lowermost part of the stack downwardly toward the slide means, the slide means including a first longitudinally elongated slide member that has a longitudinally extending top slide surface extendable under said tabs and blank portions, a second longitudinally elongated slide member adjacent the said first member slide surface and having a first longitudinal end portion that has a top slide surface portion at substantially the same elevation as the transversely adjacent part of the first member top surface, a longitudinally elongated intermediate portion having a top slide surface that is curved to extend progressively greater distances above the transversely adjacent parts of the first member top surface in na forward direction and then progressively smaller distances above the transversely adjacent parts of the first member top surface, and a second end portion having a top slide surface that is at substantially the same elevation as the transversely adjacent part of the first member top surface, said second member being mounted to have its intermediate portion beneath the tabs and blank portions, said first member having a vacuum port opening through the top surface thereof beneath the lowermost tab and transversely opposite one of the second member end portions for pulling said lowermost tab downwardly.

2. The apparatus of claim 1 further characterized in that the feed means includes a feed wheel rotated about a transverse axis beneath the stack and in a position for engaging the lowermost blank front portion to aid in feeding the lowermost blank forwardly, said feed wheel having a circumferential polished metal surface portion and a circumferential surface portion having a substantially higher coefficient of friction than said metal portion angular spaced from the metal portion, cooperating rolls forming an entry nip forwardly of blocking means, endless conveyor means for engaging the lowermost blank rear edge and feeding the lowermost blank to said entry nip, said endless means being entirely located rearwardly of the blocking means, and means for mounting said wheel, rolls and endless means and for driving said wheel, at least one of said rolls, and the endless means in synchronism.

3. The apparatus of claim 2 further characterized in that the last mentioned driving means includes means for initially accelerating the endless means from a stop condition to move the lowermost blank at the linear speed of the driven cooperating roll prior to the blank entering the entry nip and after the blanks entrance to the entry nip decelerating the endless means to a stop condition, and means for driving the driven cooperating roll at a constant rate while the accelerating and decelerating means is accelerating and decelerating the endless means.

4. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine said feed means including an endless chain having a longitudinally extending upper run extending beneath at least the rear portion of the stack of blanks, means for mounting the chain and driving the chain to have the upper run move in a forward direction, a wedge mounted on said chain to be carried thereby, said wedge having a ramp surface inclined relative the chain to extend closer to the chain in the direction of chain travel, said wedge ramp surface being transversely arcuately curved to have transverse opposite side portions and a transverse central portion that extends more remote from the chain than the transversely corresponding parts of the side portions, and a ledge mounted on said wedge to extend further outwardly of the chain than said ramp surface, adjacent the ramp surface and rearwardly thereof relative the direction of chain travel for positively engaging the rear edge of the lowermost blank on the slide means to move the lowermost blank forwardly as the chain is driven, said slide means having a longitudinal elongated slide surface portion located in a plane generally parallel to the path of movement of the lowermost blank thereover as the blank is fed forwardly, said wedge when on the upper run having a front surface portion that is located beneath said plane and a rear surface portion that extends above said plane, means on the frame and adjacent the front of the stack of blanks for blocking the movement of the stack of blanks other than the lowermost blank to said machine, and hold down means on the frame for constantly resiliently urging rear end portions of at least the lowermost part of the stack downwardly toward the slide means.

5. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, said feed means including an endless chain having a longitudinally extending upper run extending beneath at least the rear portion of the stack of blanks, means for mounting the chain and driving the chain to have the upper run move in a forward direction, a wedge mounted on said chain to be carried thereby, said wedge having a ramp surface inclined relative the chain to extend closer to the chain in the direction of chain travel, and a ledge mounted on said wedge to extend further outwardly of the chain than said ramp surface, adjacent the ramp surface and rearwardly thereof relative the direction of chain travel for positively engaging the rear edge of the lowermost blank on the slide means to move the lowermost blank forwardly as the chain is driven, said feed means including a plurality of additional wedges and ledges mounted on the chain such that the wedges are in equal spaced relationship along the length of the chain, said drive means includes a continuously driven mechanism that is synchronized with the drive to the machine, driven means drivingly connected to the chain, and means for drivingly connecting the driven mechanism to the means drivingly connected to the chain for a period of time that one ledge is moved from a position just rearwardly adjacent the lowermost blank rear edge to a position that the adjacent trailing ledge on the chain is just rearward of and adjacent the rear edge of the next to lowermost blank of the stack and then interrupting the drive to the means drivingly connected to the chain, means on the frame and adjacent the front of the stack of blanks for blocking the movement of the stack of blanks other than the lowermost blank to said machine, and hold down means on the frame for constantly resiliently urging rear end portions of at least the lowermost part of the stack downwardly toward the slide means.

6. The apparatus of claim 5 further characterized in that the ledges are spaced along the chain so that only one ledge at a time is located on the upper run portion that extends forwardly of the stack rear edge.

7. The apparatus of claim 5 further characterized in that the intermittently drivingly connecting means comprises a clutch assembly having constantly rotatable dog mechanism, a sprocket, a driven dog, a brake, a braking surface portion, means mounting the driven dog on the sprocket for axial movement relative thereto between a position in driving engagement with the dog mechanism to drive the sprocket and a second position out of driving engagement with the dog mechanism, the last mentioned means mounting the brake for positioning the brake in braking engagement with said brake surface when the dog is in the second position, operable means for operating the dog from its first position to its second position, and solenoid operated means on the frame for operating said operable means.

8. The apparatus of claim 7 further characterized in that the operable means comprises a transversely movable shaft that rotatably mounts said dog and sprocket, said shaft having means for moving the dog to its second position as the shaft is moved axially in one direction, and that said solenoid means includes a reciprocally mounted slide, and actuator means mounted on the shaft for transversely moving the shaft as the slide is reciprocated.

9. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, means on the frame and adjacent the front of the stack of blanks for blocking the movement of the stack of blanks other than the lowermost blank to said machine, and hold down means on the frame for constantly resiliently urging rear end portions of at least the lowermost part of the stack downwardly toward the slide means, said hold down means comprising a hold down member having forwardly facing serrations for engaging the stack rear edge portion, and means mounting the hold down member for limited generally vertical movement and constantly resiliently urging the hold down member downwardly.

10. The apparatus of claim 9 further characterized in that said feed means comprises means for elevating the rear portion of the stack a limited amount as the lowermost blank is moved forwardly and thence permit the rear portion of the stack to move downwardly.

11. The apparatus of claim 9 further characterized in that the slide means includes a longitudinally elongated track, and a housing mounted on the track for being retained in selected longitudinally adjusted positions thereon, and that the hold down means is mounted on the housing.

12. The apparatus of claim 11 further characterized in that the slide means includes a longitudinally elongated, telescopic blank support member having a rear portion that is attached to said housing, and that there is provided a magazine bracket that is mounted on the housing for abutting against one longitudinal rear edge portion of the blanks in the stack to aid in retaining the blanks in general vertical alignment.

13. The apparatus of claim 12 further characterized in that the slide member has a front end portion, and that the slide means includes a bracket for mounting the slide member front end portion on the track and means mounted on the frame for mounting the track for transverse adjustment.

14. The apparatus of claim 12 further characterized in that said slide member has a front end portion having a front part that has a generally horizontally extending blank slide edge, said slide member rearwardly of said front portion having a blank slide edge that is inclined downwardly and rearwardly at a substantial angle relative the horizontal.

15. The apparatus of claim 14 further characterized in that the feed means includes a feed wheel mounted for rotation about a transverse axis and having an upper circumferential portion transversely aligned with and at about the same elevation as the juncture of said horizontal edge and the inclined edge, said wheel having circumferentially spaced inserts that have circumferentially outer surfaces portions of a material such as rubber, and polished metal circumferential surfaces extending circumferentially between said inserts.

16. The apparatus of claim 15 further characterized in that said inclined surface lies in a blank slide plane, that said blocking means comprises escape bars having lower terminal edges that terminate at substantially an intersection with said plane, that the juncture of said horizontal edge and inclined edge is a substantial distance rearwardly of the escape bar terminal edges, and that said slide member has a vacuum port opening upwardly adjacent the juncture of the horizontal and inclined edges and forwardly thereof for applying a vaccum to pull the vertically adjacent part of the lowermost blank downwardly to permit passage of the blank beneath the escape bars.

17. The apparatus of claim 16 further characterized in that the feed means includes feed roll means having an entry nip forwardly of the escape bars for aiding in moving the lowermost blank forwardly, an endless chain having a longitudinally extending upper run extending beneath the lowermost blank in the stack and generally parallel thereto, and means mounted on the chain to, as it is moved along the upper run, engage the rear edge of the lowermost blank and move it forwardly, said upper run being located and terminating longitudinally rearwardly of the escape bars and being of a length to extend forwardly of the stack rear edge a distance that is greater than the distance between the lower terminal edges of the escape bars and the entry nip.

18. For successively moving the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means and into the processing machine, and a magazine on the frame for retaining the stack in aligned relationship while permitting the lowermost blank being fed forwardly, said magazine having vertically elongated escape bars for abutting against the front transverse edges of the blanks in the stack, said bars having lower terminal edges, said slide means including a pair of longitudinally elongated, transversely spaced slide members, each slide member having a front, generally horizontal top edge portion extending forwardly of the escape bars, an elongated rear top edge portion rearwardly of the front edge portion and inclined downwardly and rearwardly at a substantial angle to the horizontal and a curved top edge portion located a short distance longitudinally rearwardly of the escape bars, at a lower elevation of said terminal edges, and joining the top and rear edge portions, the rear top edges being located in a blank slide plane that intersects with the escape bars, said slide members having vacuum ports opening through the top edge portions for applying a vacuum to the lowermost blank front portion to pull it below the terminal edges of the escape bars.

19. The apparatus of claim 18 further characterized in that the feed means includes a driven feed wheel transversely adjacent each slide member and mounted to have an upper circumferential portion thereof abut against the lowermost most blank front portion when said blank front portion has been pulled down by vacuum applied through said ports, said wheel having a circumferential insert that has a circumferential surface of a substantially higher coefficient of friction than the angularly adjacent circumferential part of the wheel.

20. The apparatus of claim 19 wherein the blanks in the stack have transverse notches or slits providing tabs and blank portions extending horizontally adjacent thereto with the tabs and blank portions of the blanks in the stack respectively above one another, further characterized in that the slide means includes a longitudinally elongated slide device mounted adjacent one of the slide members and having a top edge that in a forward direction is at about the same elevation as the top edge of the adjacent slide member, then progressively extends to higher distances above the transversely adjacent parts of the adjacent slide member top edge, thence progressively lower distances above the transversely adjacent parts of the adjacent slide member top edge, and then at about the same elevation as the top edge of the adjacent slide member, said device being mounted to support the vertically adjacent parts of the lowermost blank portion and tab above the transverse adjacent parts of adjacent slide member, said adjacent slide member having a vacuum port opening through its top edge to the tab of the lowermost blank in the stack prior to its being fed forwardly at a location that the device top edge is at about the same elevation as the adjacent member top edge.

21. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, and magazine means on the frame for retaining the blanks in the stack on the slide means in generally vertical alignment while permitting the lowermost blank being fed forwardly, said feed means including a first gear, means for driving said first gear, a second gear, a cage member including gear members for drivingly connecting the first gear to second gear, said first and second gears and cage member being mounted for angular movement about a common axis, means drivenly connected to the second gear for moving the lowermost blank forwardly, an eccentric having a shaft that has a central axis, an eccentric mount having a central axis mounting said shaft to have the shaft axis parallel to and offset from said mount axis and permitting said shaft being selectively rotatably positioned relative to the mount, a link having one end pivotally connected to the eccentric offset from the shaft axis and an opposite end pivotally connected to the cage for pivoting the cage first in one angular direction and then the other angular direction as the eccentric is rotated about the mount axis, said first gear and mount having cooperating means for rotating the mount about its axis as the first gear is driven, and adjustment means for retaining the shaft in selected adjusted angular positions relative the mount for varying the rate of acceleration and deceleration imparted from the first gear through the cage member to the second gear.

22. The apparatus of claim 21 further characterized in that the feed means includes a housing having the said first and second gears, eccentric, mount and cage member mounted thereon, said adjustment means extending exterior of the housing.

23. The apparatus of claim 22 further characterized in that there is provided a longitudinally elongated track on the frame mounting the housing for selected adjusted longitudinal movement therealong, the means for driving first gear including a third gear rotatably mounted by the housing, a longitudinally elongated shaft rotatably mounted on the track and having an axially elongated keyway, a fourth gear on the last mentioned shaft and having a key axially slidably extend into the keyway for driving the fourth gear as said last mentioned shaft is rotated, said fourth gear being in driving relationship to the third gear and rotatably mounted on the housing to be adjusted longitudinally therewith.

24. The apparatus of claim 23 further characterized in that the slide means includes a longitudinally elongated telescopic slide member having a rear portion mounted on the housing and a front end portion mounted on said track, means mounted on the frame for selectively adjusting the transverse position of the track, and that the magazine means includes means mounted on the housing for abutting against an edge of said stack.

25. For successively feeding the lowermost blank from a generally vertical stack of blanks, one after another, in a longitudinally forward direction into a processing machine such as a carton folding machine, having a given blank linear speed, blank feeder apparatus comprising longitudinally extending slide means on the frame for supporting the stack of blanks, means on the frame for feeding the lowermost blank along the slide means into the processing machine, magazine means on the frame for retaining the blanks in the stack in aligned relationship while permitting the lowermost blank being fed forwardly and means for driving the feed means, the drive means including a first shaft rotatably mounted on the frame, means for drivingly connecting the first shaft to the feed means, a clutch housing on the frame, a second shaft mounted for limited axial movement by the housing, a continuously driven third shaft, dog means rotatably mounted on the second shaft and drivingly connected to the third shaft, a solenoid mounted on the frame and having a reciprocal solenoid member, mechanical means connected to solenoid member and to the second shaft for moving the second shaft in one axial direction as the solenoid member is moved in one direction, a sprocket mounted in the housing in a fixed axial position and rotatably about the second shaft, means for drivingly connecting the sprocket to the first shaft, a dog mounted on the second shaft for rotatable movement relative thereto, means mounting the dog on the sprocket for axial movement relative thereto between a position to provide a driving connection between the dog and dog means and breaking the driving connection therebetween and connected to the sprocket for rotating the sprocket when the dog means is being rotated and the dog is in the position providing the driving connection, means for resiliently urging the dog to said driving connection position, said second shaft having means for moving the dog to its second position as said second shaft is moved in said one direction.

26. The apparatus of claim 25 further characterized in that said housing has a brake surface and that a brake is mounted on the means mounting the dog on the sprocket for engaging said brake surface when the second shaft moves the dog to its second position, and that the means connected to the solenoid member includes a slide member slidably mounted on the frame and connected to the solenoid member to be reciprocated by the solenoid member, and an actuator mounted on the second shaft for limited axial movement relative thereto for moving the second shaft between its positions as the solenoid member is moved between its positions.

27. The apparatus of claim 26 further characterized in that the feed means includes a feed wheel keyed to the first shaft for engaging the front portion of the lowermost blank, said feed wheel having a circumferential insert surface portion for exerting a pulling force on the lowermost blank, means for engaging the rear edge of the lowermost blank in the stack for feeding it forwardly, means drivingly connected to the first shaft for first accelerating the rear edge engaging means to the linear speed of the processing machine and then decelerating it, cooperating roll means forming an entry nip forwardly of the stack front edge, including a driven roll, a fourth shaft for mounting the driven roll and having it keyed thereto, and means for drivingly connecting the first shaft to the fourth shaft to drive the fourth shaft at a constant speed when the first shaft is being driven.

28. The apparatus of claim 27 further characterized in that there is provided control means for sensing the movement of a blank into the processing machine to be moved thereby and thereupon operating the solenoid to move its solenoid member whereby the second shaft is moved in its one axial direction.

29. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, and magazine means on the frame for retaining the blanks in generally vertical stacked relationship while permitting the lowermost blank in the stack being fed forwardly on the slide means into the processing machine, said magazine means having a front escape member, a vertically elongated hold down member having serrations for abutting against the rear edge of the stack, and means mounting the hold down member for limited vertical movement and resiliently urging the hold down member downwardly, the feed means including an endless chain having a longitudinally extending upper run extending both rearwardly and forwardly of the rear edge of the stack, several wedges mounted in evenly spaced relationship along the length of the chain, each wedge having a ramp surface for elevating the adjacent part of the stack as the wedge moves forwardly, a ledge mounted on each wedge to extend further outwardly from the chain than the wedge on which it is mounted for engaging the rear edge of the lowermost blank as it is moved forwardly along the upper run, and drive means for driving the chain upper run to move it in a forward direction.

30. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, and magazine means on the frame for retaining the blanks in generally vertical stacked relationship while permitting the lowermost blank in the stack being fed forwardly on the slide means into the processing machine, said magazine means having a front escape member, said feed means including an endless chain having a longitudinally extending upper run extending both rearwardly and forwardly of the rear edge of the stack, several wedges mounted in evenly spaced relationship along the length of the chain, each wedge having a ramp surface for elevating the adjacent part of the stack as the wedge moves forwardly, a ledge mounted on each wedge to extend further outwardly from the chain than the wedge on which it is mounted for engaging the rear edge of the lowermost blank as it is moved forwardly along the upper run, and a feed wheel rotatable about a transverse axis and mounted to engage the lowermost blank lower surface longitudinally rearwardly of and adjacent the front of the stack, said wheel having a first circumferential portion, and a second circumferential portion angularly spaced from the first portion that has a substantially higher coefficient of friction than the coefficient of friction of the first portion, the slide means including a longitudinally elongated bar having a top edge blank slide surface transversely adjacent the feed wheel and a vacuum port opening through said top edge surface for pulling the blank into radial conformity with the transversely adjacent parts of the feed wheel, and drive means for driving the chain upper run to move it in a forward direction, said drive means being drivingly connected to said wheel for drivingly rotating said wheel so that as said second portion engages the blank it exerts a forward pulling force on the lowermost blank.

31. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, and magazine means on the frame for retaining the blanks in generally vertical stacked relationship while permitting the lowermost blank in the stack being fed forwardly on the slide means into the processing machine, said magazine means having a front escape member, the feed means including an endless chain having a longitudinally extending upper run extending both rearwardly and forwardly of the rear edge of the stack, several wedges mounted in evenly spaced relationship along the length of the chain, each wedge having a ramp surface for elevating the adjacent part of the stack as the wedge moves forwardly, a ledge mounted on each wedge to extend further outwardly from the chain than the wedge on which it is mounted for engaging the rear edge of the lowermost blank as it is moved forwardly along the upper run, and a feed wheel rotatable about a transverse axis and mounted to engage the lowermost blank lower surface longitudinally rearwardly of and adjacent the front of the stack, said wheel having a first circumferential portion, and a second circumferential portion angularly spaced from the first portion that has a substantially higher coefficient of friction than the coefficient of friction of the first portion, and drive means for driving the chain upper run to move it in a forward direction, said drive means being drivingly connected to said wheel for drivingly rotating said wheel so that as said second portion engages the blank it exerts a forward pulling force on the lowermost blank, the above mentioned drive means including first drive means for driving the wheel at a constant speed and driving the chain to accelerate the chain as a ledge engages the lowermost blank lower edge to move the lowermost blank forwardly and after the lowermost blank has been accelerated to the speed of the carton machine, decelerate the chain, second continuous drive means driven in synchronism with the machine, and means for drivingly connecting the second drive means to the first drive means and discontinuing the drive thereto after the ledge that engaged the lowermost blank rear edge has been moved along the chain upper run and in advance of the upper run in the path of movement of the chain.

32. For successively feeding the lowermost blank from a generally vertical stack of blanks, one after another, in a longitudinally forward direction into a processing machine such as a carton folding machine, blank feeder apparatus comprising a frame, longitudinally extending slide means on the frame for supporting the stack of blanks, means on the frame for feeding the lowermost blank in the stack forwardly along the slide means into the processing machine, and means on the frame and adjacent the front of the stack of blanks for blocking the movement of the stack of blanks other than the lowermost blank to said machine, said feed means including a feed wheel rotated about a transverse axis beneath the stack and in a position for engaging the lowermost blank front portion to aid in feeding the lowermost blank forwardly, cooperating rolls forming an entry nip forwardly of the blocking means, endless conveyor means for engaging the lowermost blank rear edge and feeding the lowermost blank to said entry nip, said endless means being entirely located rearwardly of the blocking means, and mounting and driving means for mounting said wheel, rolls and endless means and driving said wheel, at least one of said rolls, and the endless means in synchronism, the mounting and driving means including means for initially accelerating the endless means up to a speed to move the lowermost blank at the linear speed of the driven cooperating roll prior to the blank entering the entry nip and after the blanks entrance to the entry nip decelerating the endless means, and means for driving the driven cooperating roll at a constant rate while the accelerating and decelerating means is accelerating and decelerating the endless means.

33. The apparatus of claim 32 further characterized in that the mounting and driving means mounts the feed wheel to engage the lowermost blank lower surface longitudinally rearwardly of and adjacent the front of the stack.

34. For successively feeding the lowermost blank from a generally vertical stack of blanks, one after another, in a longitudinally forward direction into a processing machine such as a carton folding machine wherein each blank has a front portion and a rear portion, blank feeder apparatus comprising a frame, longitudinally extending slide means on the frame for supporting the stack of blanks, means on the frame for feeding the lowermost blank in the stack forwardly along the slide means into the processing machine, and means on the frame and adjacent the front of the stack of blanks for blocking the movement of the stack of blanks other than the lowermost blank to said machine, said blocking means having a lower terminal edge, said feed means including a feed wheel rotated about a transverse axis beneath the stack and in a position for engaging the front portion of the lowermost blank in the stack to aid in feeding the lowermost blank forwardly, cooperating rolls forming an entry nip forwardly of blocking means, endless conveyor means for engaging the lowermost blank rear edge and feeding the lowermost blank to said entry nip, said endless means being entirely located rearwardly of the blocking means and having a longitudinally extending upper run that extends both longitudinally forwardly and rearwardly of the lowermost blank in the stack, and mounting and driving means for mounting said wheel, rolls and endless means and driving said wheel, at least one of said rolls, and the endless means in synchronism, the mounting and driving means including means mounting the endless means for adjustable longitudinal movement between a first position and a second position more remote from the blocking means than the first position.

35. The apparatus of claim 34 further characterized in that endless means comprises an endless chain having the endless means upper run and means mounted on the chain to, as it is moved along the upper run, engage the rear edge of the lowermost blank and move it forwardly, said upper run being located and terminating longitudinally rearwardly of the blocking means and being of a length to extend forwardly of the stack rear edge a distance that is greater than the distance between the lower terminal edge of the blocking means and the entry nip.

36. The apparatus of claim 34 further characterized in that the mounting and drive means includes means for maintaining a drive connection between the feed wheel and the endless means as the means mounting the endless means for adjustable movement is moved between its first position and second position.

37. The apparatus of claim 34 further characterized in that the means mounting the endless means includes a housing, means mounting the housing for adjustable longitudinal movement on the frame, and means mounted by the housing for movement therewith for mounting the endless means and driving the endless means.

38. The apparatus of claim 34 further characterized in that the endless means includes a driven sprocket, an endless chain driven by said sprocket, and having said upper run, and means mounted on the chain to, as it is moved along the upper run, engage the rear edge of the lowermost blank and move the lowermost blank forwardly, that the means mounting the endless means for adjustable movement includes a housing and means mounting the housing for adjustable longitudinal movement on the frame, and that the mounting and driving means includes a shaft rotatably mounted on the frame for mounting and driving the feed wheel and mechanical means for drivingly connecting the shaft to the sprocket.

39. The apparatus of claim 38 further characterized in that the mechanical means includes driven means mounted by the housing and drivingly connected to the sprocket to initially accelerate the sprocket and after the lowermost blank has entered the entry nip decelerate the sprocket, and mechanism for continuously drivingly connecting the shaft to the accelerating and decelerating means.

* * * * *